US010077726B2

(12) United States Patent
Richards et al.

(10) Patent No.: US 10,077,726 B2
(45) Date of Patent: Sep. 18, 2018

(54) SYSTEM AND METHOD TO ACTIVATE AND DEACTIVATE ENGINE CYLINDERS

(71) Applicant: Ford Global Technologies, LLC, Dearborn, MI (US)

(72) Inventors: Adam J. Richards, Canton, MI (US); John Eric Rollinger, Troy, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/386,779

(22) Filed: Dec. 21, 2016

(65) Prior Publication Data

US 2018/0171909 A1 Jun. 21, 2018

(51) Int. Cl.
*F02D 41/00* (2006.01)

(52) U.S. Cl.
CPC .... *F02D 41/0087* (2013.01); *F02D 2200/101* (2013.01); *F02D 2200/1002* (2013.01); *F02D 2200/50* (2013.01)

(58) Field of Classification Search
CPC ..... F02D 13/06; F02D 17/00; F02D 37/02; F02D 41/00; F02D 41/0087; Y02T 10/14; Y02T 10/18; Y02T 10/40; Y02T 10/50
USPC ..... 701/102, 104, 111–114; 123/294–299, 123/305, 481, 198 DB, 198 F
See application file for complete search history.

(56) References Cited

U.S. PATENT DOCUMENTS

| | | | | |
|---|---|---|---|---|
| 5,819,702 | A * | 10/1998 | Mendler | F02B 41/00 123/1 R |
| 6,443,125 | B1 * | 9/2002 | Mendler | F02B 41/00 123/316 |
| 7,647,154 | B2 | 1/2010 | Heap | |
| 8,073,601 | B2 | 12/2011 | Heap et al. | |
| 2010/0100299 | A1 * | 4/2010 | Tripathi | F02D 41/0087 701/102 |
| 2010/0211297 | A1 * | 8/2010 | Doering | F02D 13/06 701/112 |
| 2011/0030657 | A1 * | 2/2011 | Tripathi | F02D 17/02 123/481 |
| 2011/0048372 | A1 * | 3/2011 | Dibble | F02D 41/0087 123/350 |
| 2014/0172272 | A1 | 6/2014 | Tripathi et al. | |

* cited by examiner

*Primary Examiner* — John Kwon
*Assistant Examiner* — Johnny H Hoang
(74) *Attorney, Agent, or Firm* — Julia Voutyras; McCoy Russell LLP

(57) ABSTRACT

Systems and methods for determining when one or more cylinders of an engine may be activated or deactivated are presented. In one example, an actual total number of active cylinder modes may be increased in response to engine speed and load. Further, dimensions of an engine cylinder mode region of an engine cylinder activation may be adjusted responsive to a change in mass of a vehicle.

20 Claims, 5 Drawing Sheets

SYSTEM AND METHOD TO ACTIVATE AND DEACTIVATE ENGINE CYLINDERS

FIELD

The present description relates to a system and methods for selectively activating and deactivating cylinders of an engine to conserve fuel while meeting engine torque demands. The system and methods vary which cylinders of an engine fire from one engine cycle to the next engine cycle.

BACKGROUND AND SUMMARY

Some engines include a fixed group of cylinders that may be selectively activated and deactivated in response to vehicle conditions. For example, during light vehicle driver demand conditions, a fixed group of engine cylinders may be deactivated to conserve fuel. If vehicle driver demand increases, the same group of cylinders may be reactivated to meet the vehicle driver demand. Such engines may improve fuel efficiency over similar engines that operate with all cylinders active all of the time; however, cylinder reactivation delays may reduce engine responsiveness and deactivating the same cylinder all of the time may cause uneven degradation between engine cylinders.

Other engines have been developed that may deactivate or activate any engine cylinder at virtually any time depending on select vehicle operating conditions. Further, these engines may vary which cylinders are activated and deactivated so that wear between cylinders may be more even. Nevertheless, these engines may transmit vibrations related to the activation and deactivation of cylinders to the vehicle and its occupants. The engine vibrations may be mitigated so as to not disturb vehicle occupants by not allowing selected cylinder firing fractions and/or cylinder deactivation patterns during predetermined conditions. However, some vibrations may be still be noticeable to vehicle occupants during some engine operating conditions. Therefore, it may be desirable to seek to reduce the possibility of transmitting engine vibration to vehicle occupants during a broader range of engine operating conditions.

The inventors herein have recognized the above-mentioned issues and have developed an engine method, comprising: increasing an actual total number of engine cylinder modes that include active cylinders according to an engine cylinder mode region of an engine cylinder activation map via a controller in response to a change of engine speed or engine load, the cylinder mode region adjusted in response to a change in vehicle mass; and activating and deactivating engine cylinders in response to the change of engine speed or engine load.

By adjusting a range of an engine cylinder mode region of an engine cylinder activation map, it may be possible to provide the technical result of reducing the possibility of disturbing vehicle occupants when cylinder mode changes are made. In particular, an engine speed and load range where additional active engine cylinder modes and additional deactivated engine cylinder modes are provided may be increased or decreased in size so that cylinder modes that may influence vibrations felt by vehicle occupants may be avoided in response to changes in vehicle mass. The vehicle's mass and location of mass of the vehicle may affect transmission of vibrations related to modes where one or more engine cylinders are deactivated. As such, adjusting size of one or more engine cylinder mode regions may help avoid the possibility of disturbing vehicle occupants due to vibrations that may be related to cylinder modes where one or more engine cylinders may be deactivated.

The present description may provide several advantages. For example, the approach may improve vehicle drivability. Further, the approach provides adjustments to which cylinder modes are allowable responsive to location of vehicle mass. In addition, the approach may also compensate for vibrations when a trailer is towed by the vehicle.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

Figure 1:
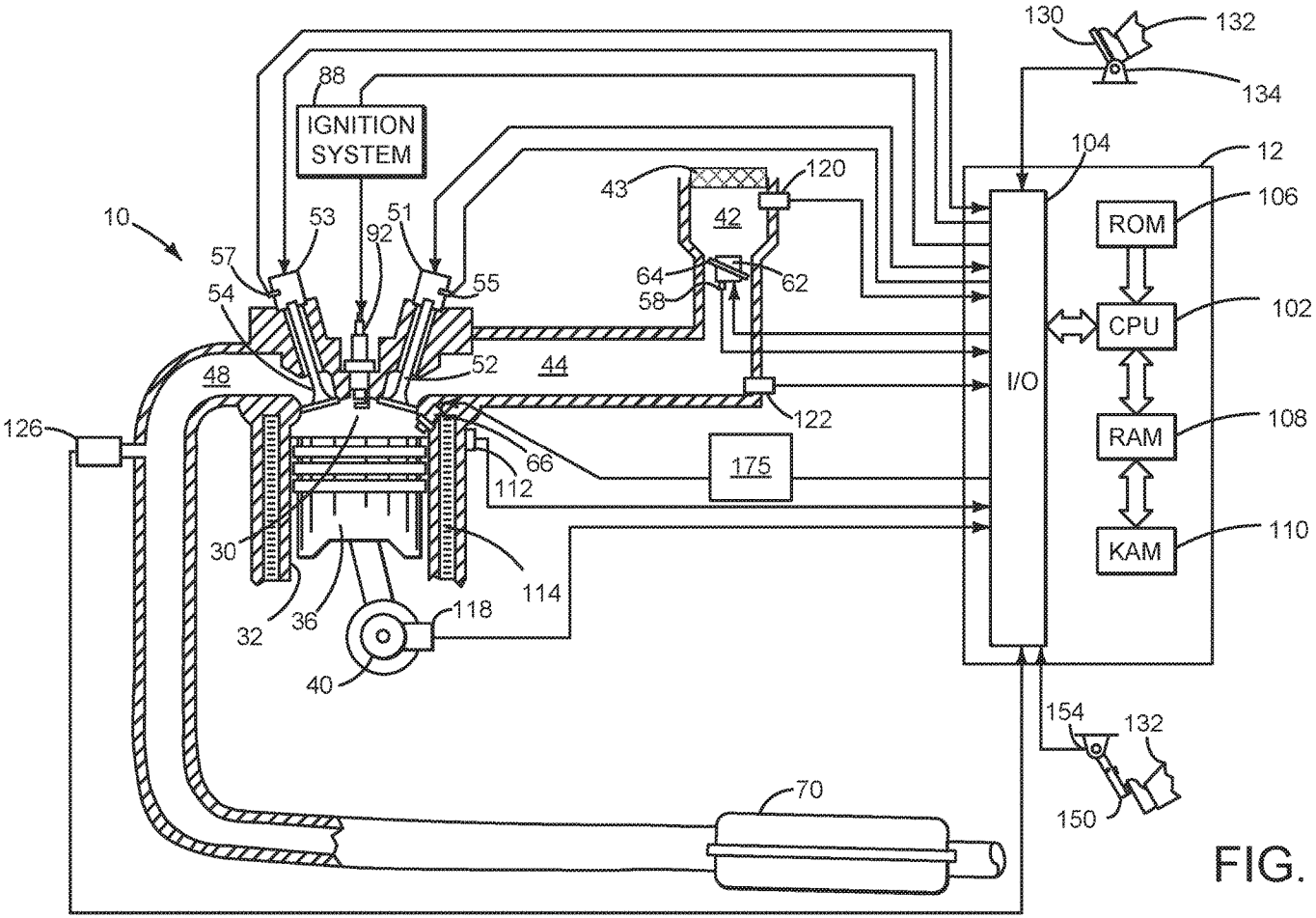
FIG. 1 is a schematic diagram of an engine.
Figure 2A:
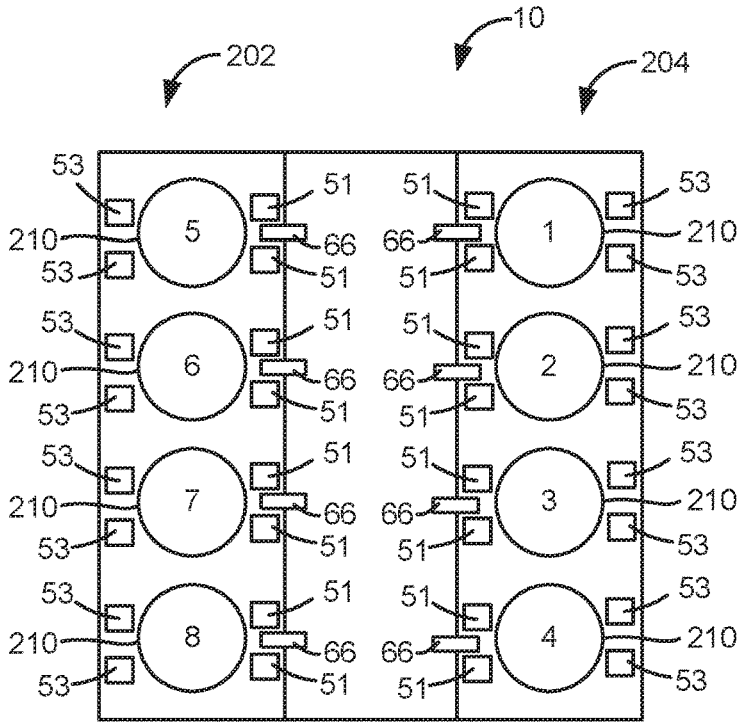
FIG. 2A is a schematic diagram of an eight cylinder engine with two cylinder banks.
Figure 2B:
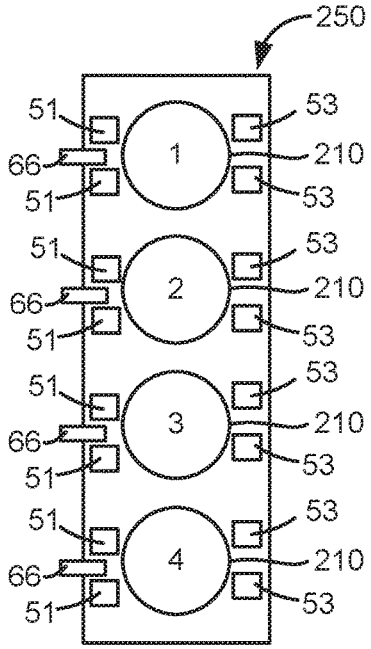
FIG. 2B is a schematic diagram of a four cylinder engine with a single cylinder bank.
Figure 3A:
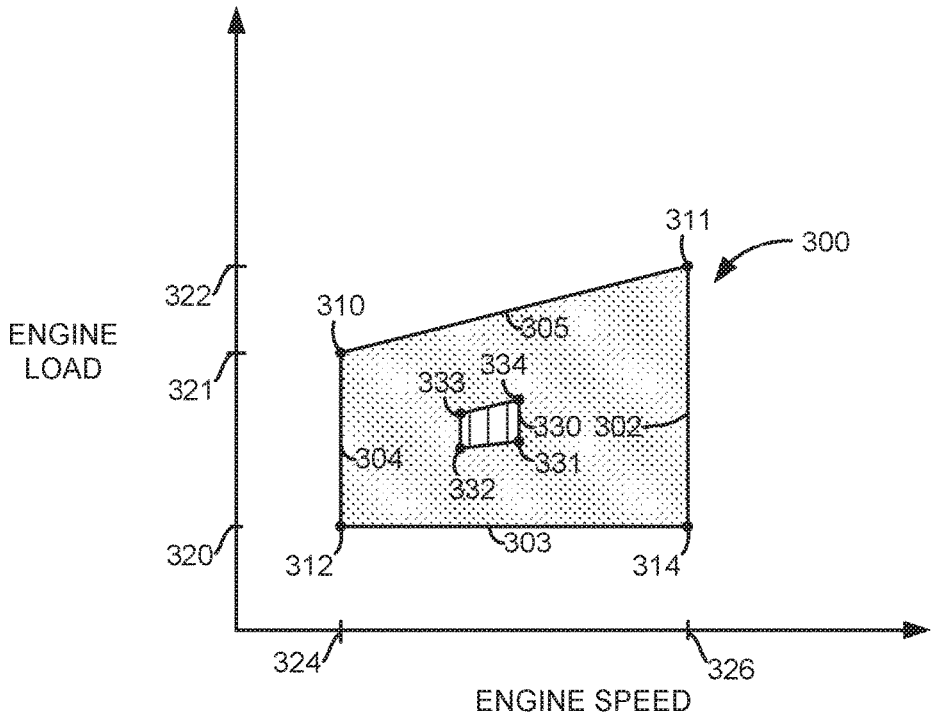
FIG. 3A is plot showing an exemplary cylinder deactivation map.
Figure 3B:
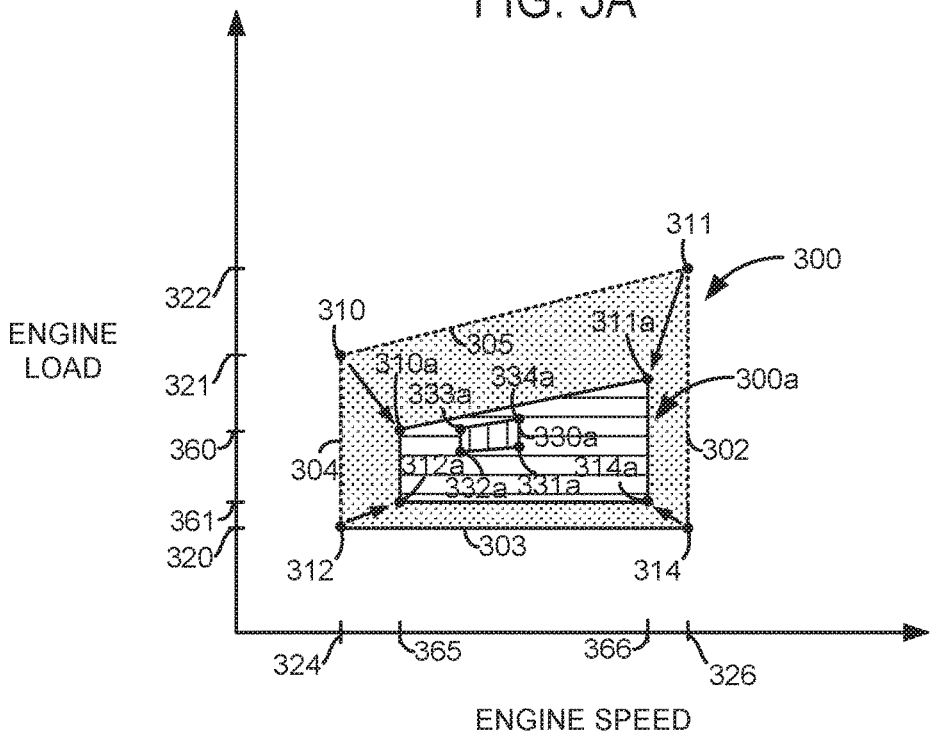
FIG. 3B is a plot showing how a cylinder deactivation may be adjusted responsive to vehicle mass.
Figure 4:
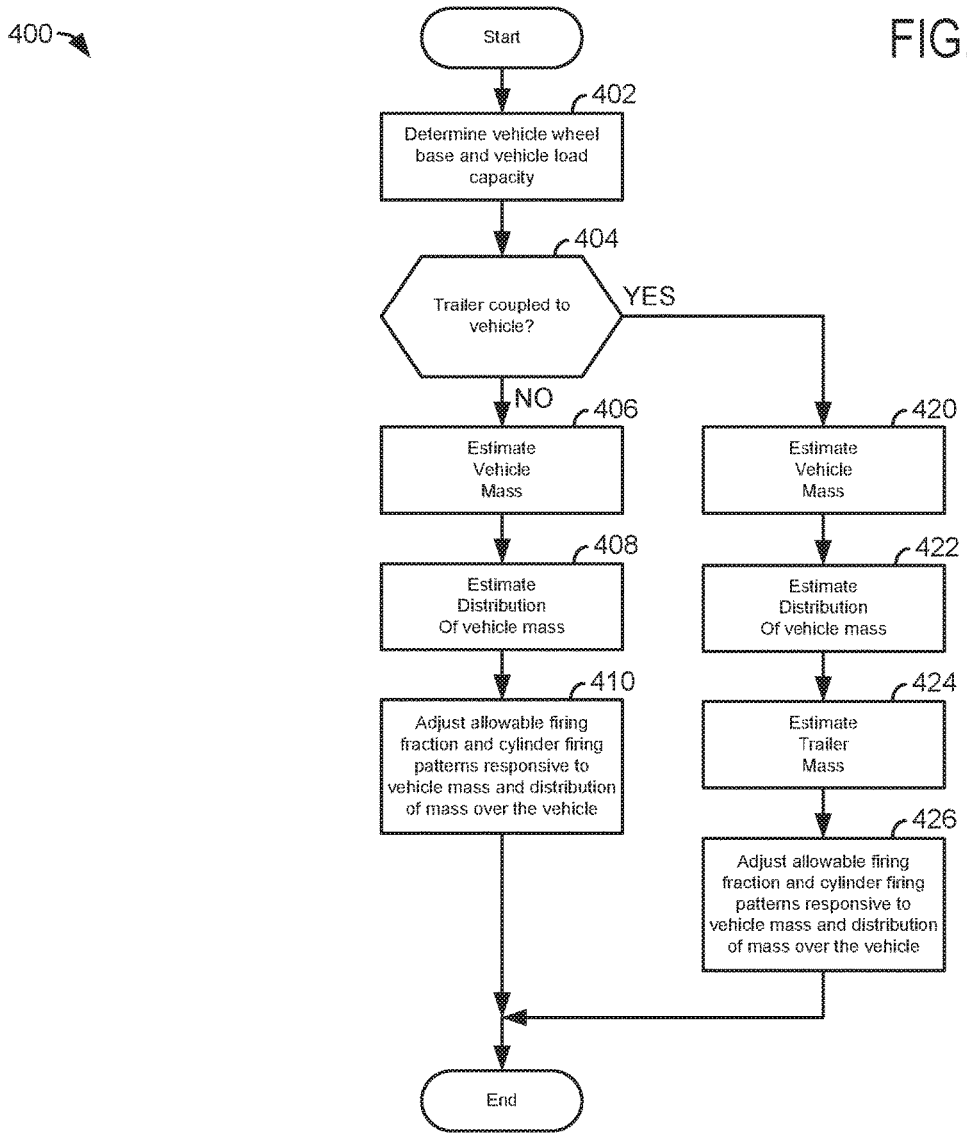
FIG. 4 shows a flow chart of an example method for operating an engine.

The present description is related to controlling activation and deactivation of engine cylinders responsive to vehicle mass, trailer tow mass, and distribution of vehicle weight. An engine and its related components are shown in FIG. 1. FIGS. 2A and 2B show example configurations for the engine described in FIG. 1. FIG. 3A shows an example cylinder deactivation map that includes two cylinder mode selection regions, a first cylinder mode selection region within the bounds of a second cylinder mode selection region. A method for operating the engine of FIGS. 1-2B according to the map shown in FIG. 3B is shown in FIG. 4. In the context of this disclosure, a cylinder is activated when it is combusting air and fuel during an engine cycle (e.g., two engine revolutions for a four stroke engine). A cylinder is deactivated when it is not combusting air and fuel during an engine cycle.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40.

Combustion chamber 30 is shown communicating with intake manifold 44 and exhaust manifold 48 via respective intake valve 52 and exhaust valve 54. Each intake and exhaust valve may be operated by a variable intake valve operator 51 and a variable exhaust valve operator 53, which may be actuated mechanically, electrically, hydraulically, or by a combination of the same. For example, the valve actuators may be of the type described in U.S. Patent Publication 2014/0303873 and U.S. Pat. Nos. 6,321,704; 6,273,039; and 7,458,345, which are hereby fully incorporated for all intents and purposes. Intake valve operator 51 and an exhaust valve operator may open intake 52 and exhaust 54 valves synchronously or asynchronously with crankshaft 40. The position of intake valve 52 may be determined by intake valve position sensor 55. The position of exhaust valve 54 may be determined by exhaust valve position sensor 57.

Fuel injector 66 is shown positioned to inject fuel directly into cylinder 30, which is known to those skilled in the art as direct injection. Alternatively, fuel may be injected to an intake port, which is known to those skilled in the art as port injection. Fuel injector 66 delivers liquid fuel in proportion to the pulse width of signal from controller 12. Fuel is delivered to fuel injector 66 by a fuel system 175. In addition, intake manifold 44 is shown communicating with optional electronic throttle 62 (e.g., a butterfly valve) which adjusts a position of throttle plate 64 to control air flow from air filter 43 and air intake 42 to intake manifold 44. Throttle 62 regulates air flow from air filter 43 in engine air intake 42 to intake manifold 44. In one example, a high pressure, dual stage, fuel system may be used to generate higher fuel pressures. In some examples, throttle 62 and throttle plate 64 may be positioned between intake valve 52 and intake manifold 44 such that throttle 62 is a port throttle.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106 (e.g., non-transitory memory), random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by human driver 132; a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; brake pedal position from brake pedal position sensor 154 when human driver 132 applies brake pedal 150; and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

In some examples, the engine may be coupled to an electric motor/battery system in a hybrid vehicle. Further, in some examples, other engine configurations may be employed, for example a diesel engine.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

Referring now to FIG. 2A, an example multi-cylinder engine that includes two cylinder banks is shown. The engine includes cylinders and associated components as shown in FIG. 1. Engine 10 includes eight cylinders 210. Each of the eight cylinders is numbered and the numbers of the cylinders are included within the cylinders. Fuel injectors 66 selectively supply fuel to each of the cylinders that are activated (e.g., combusting fuel during a cycle of the engine). Cylinders 1-8 may be selectively deactivated to improve engine fuel economy when less than the engine's full torque capacity is requested. For example, cylinders 2, 3, 5, and 8 (e.g., a fixed pattern of deactivated cylinders) may be deactivated during an engine cycle (e.g., two revolutions for a four stroke engine) and may be deactivated for a plurality of engine cycles while engine speed and load are constant or very slightly. During a different engine cycle, a second fixed pattern of cylinders 1, 4, 6, and 7 may be deactivated. Further, other patterns of cylinders may be selectively deactivated based on vehicle operating conditions. Additionally, engine cylinders may be deactivated such that a fixed pattern of cylinders is not deactivated over a plurality of engine cycles. Rather, cylinders that are deactivated may change from one engine cycle to the next engine cycle. Each cylinder includes variable intake valve operators 51 and variable exhaust valve operators 53. An engine cylinder may be deactivated by its variable intake valve operators 51 and variable exhaust valve operators holding intake and exhaust valves of the cylinder closed during an entire cycle of the cylinder. An engine cylinder may be activated by its variable intake valve operators 51 and variable exhaust valve operators 53 opening and closing intake and exhaust valves of the cylinder during a cycle of the cylinder. Engine 10 includes a first cylinder bank 204, which includes four cylinders 1, 2, 3, and 4. Engine 10 also includes a second cylinder bank 202, which includes four cylinders 5, 6, 7, and 8. Cylinders of each bank may be active or deactivated during a cycle of the engine.

Referring now to FIG. 2B, an example multi-cylinder engine that includes one cylinder bank is shown. The engine includes cylinders and associated components as shown in FIG. 1. Engine 10 includes four cylinders 210. Each of the four cylinders is numbered and the numbers of the cylinders are included within the cylinders. Fuel injectors 66 selectively supply fuel to each of the cylinders that are activated (e.g., combusting fuel during a cycle of the engine with intake and exhaust valves opening and closing during a cycle of the cylinder that is active). Cylinders 1-4 may be selectively deactivated (e.g., not combusting fuel during a cycle of the engine with intake and exhaust valves held closed over an entire cycle of the cylinder being deactivated) to improve engine fuel economy when less than the engine's full torque capacity is requested. For example, cylinders 2 and 3 (e.g., a fixed pattern of deactivated cylinders) may be deactivated during a plurality of engine cycles (e.g., two revolutions for a four stroke engine). During a different engine cycle, a second fixed pattern cylinders 1 and 4 may be deactivated over a plurality of engine cycles. Further, other patterns of cylinders may be selectively deactivated based on vehicle operating conditions. Additionally, engine cylinders may be deactivated such that a fixed pattern of cylinders is not deactivated over a plurality of engine cycles. Rather, cylinders that are deactivated may change from one engine cycle to the next engine cycle. In this way, the deactivated engine cylinders may rotate or change from one engine cycle to the next engine cycle.

Engine 10 includes a single cylinder bank 250, which includes four cylinders 1-4. Cylinders of the single bank may be active or deactivated during a cycle of the engine. Each cylinder includes variable intake valve operators 51 and variable exhaust valve operators 53. An engine cylinder may be deactivated by its variable intake valve operators 51 and variable exhaust valve operators holding intake and exhaust valves of the cylinder closed during a cycle of the cylinder. An engine cylinder may be activated by its variable intake valve operators 51 and variable exhaust valve operators 53 opening and closing intake and exhaust valves of the cylinder during a cycle of the cylinder.

The system of FIGS. 1-2B provides for an engine system, comprising: an engine including one or more cylinder deactivating mechanisms; a controller including executable instructions stored in non-transitory memory to adjust dimensions of an engine cylinder mode region in response to a change in mass of a vehicle. The engine system further comprises additional executable instructions to adjust the engine cylinder mode region in response to a wheel base of the vehicle. The engine system further comprises additional executable instructions to adjust the engine cylinder mode region in response to the vehicle towing a trailer. The engine system further comprises additional instructions to estimate a mass of the vehicle. The engine system further comprises additional instructions to estimate mass of a trailer coupled to the vehicle. The engine system includes where the engine cylinder mode region defines active cylinder firing fractions and active cylinder patterns.

Referring now to FIG. 3A, a plot of an example cylinder activation map is shown. The vertical axis represents engine load, or alternatively torque, and engine load increases in the direction of the vertical axis arrow. The horizontal axis represents engine speed and engine speed increases in the direction of the horizontal axis arrow. The cylinder mode regions shown are not meant to be limiting, but are instead shown to illustrate the concepts described herein.

A first cylinder mode region 300 is defined by points 310, 311, 312, and 314. Lines 302, 303, 304, and 305 indicate the extents of the first cylinder mode region 300. The first cylinder mode begins at a lower engine speed indicated at 324 and extends to a higher engine speed indicated at 326. The first cylinder mode region 300 begins at a lower engine load 320 and it extends to a higher engine load 322, except at lower engine speeds, the first cylinder mode region 300 extends to engine load 321.

The first cylinder mode region 300 may allow only selected cylinder firing patterns to be activated. For example, for an eight cylinder engine having a firing order of 1, 3, 7, 2, 6, 5, 4, 8, the first cylinder mode region may allow all eight cylinders to be active (e.g., combusting air and fuel during a cycle of the engine) in a first cylinder firing pattern during an engine cycle, allow only cylinders numbered 1, 7, 6, and 3 to be active in a second cylinder firing pattern during an engine cycle, allow only cylinders numbered 3, 2, 5, and 8 to be activated in a third cylinder firing pattern during an engine cycle, and allow only cylinders numbered 1 and 6 to be activated in a fourth cylinder firing pattern during an engine cycle. Other cylinder firing patterns may not be allowed. For example, a firing pattern of 1, 3, 7, 2 is not allowed in this example. In the area outside of first cylinder mode region 300 only a mode where all engine cylinders are active is permitted. Thus, within first cylinder mode region 300 the actual number of allowable active cylinder modes is increased and the actual number of allowable cylinder deactivation modes is increased.

The first cylinder mode region 300 may also allow only selected cylinder firing fractions over a predetermined number of engine cycles. A cylinder firing fraction may be defined as an actual total number of cylinder firing events divided by an actual total number of cylinder compression strokes over a predetermined actual total number of cylinder compression strokes. For example, if an engine fires (e.g., combusts an air-fuel mixture) three times while the engine rotates through ten compression strokes, the cylinder firing fraction is 0.333. Thus, as an example, cylinder mode region 300 may allow a cylinder firing fraction of 1 during a predetermined actual total number of engine cycles, allow a cylinder firing fraction of 0.5 during a cylinder during a predetermined actual total number of engine cycles, and allow a cylinder firing fraction of 0.666 during a predetermined actual total number of engine cycles. All other cylinder firing fractions are not allowed in this example. Thus, within first cylinder mode region 300 the actual number of allowable cylinder firing fractions is increased as compared to the area outside of region 300, which requires all cylinders to be active in this example.

FIG. 3A also shows a second cylinder mode region 330 that is defined by points 331, 332, 333, and 334. Second cylinder mode region 330 is shown being within first cylinder mode region 300. However, in other examples, second cylinder mode region 330 may be outside of first cylinder mode region 300. Additionally, in other examples, additional cylinder mode regions may be provided within the first cylinder mode region 330 or outside of the first cylinder mode region 330. Second cylinder mode region 330 may allow fewer or more cylinder firing patterns and cylinder firing fraction than are included in the first cylinder mode region 300. For example, second cylinder mode region may allow all eight cylinders to be activated in a first cylinder firing pattern during an engine cycle, allow only cylinders numbered 1, 7, 6, and 3 to be active in a second cylinder firing pattern during an engine cycle, allow only cylinders numbered 3, 2, 5, and 8 to be activated in a third cylinder firing pattern during an engine cycle, allow only cylinders numbered 1 and 6 to be activated in a fourth cylinder firing pattern during an engine cycle, and allow only cylinders 3 and 8 to be activated in a fifth cylinder firing pattern during an engine cycle. All other cylinder firing patterns are not allowed in this example. Alternatively, second cylinder firing pattern may allow all eight cylinders to be active (e.g., combusting air and fuel during a cycle of the engine) in a first cylinder firing pattern during an engine cycle, and allow only cylinders numbered 1, 7, 6, and 3 to be active in a second cylinder firing pattern during an engine cycle. All other cylinder firing patterns are not allowed in this example.

The second cylinder mode region 300 may also allow different selected cylinder firing fractions over a predetermined number of engine cycles as compared to the first cylinder mode region. For example, second cylinder mode region 330 may allow a cylinder firing fraction of 1 during a predetermined actual total number of engine cycles, allow a cylinder firing fraction of 0.5 during a cylinder during a predetermined actual total number of engine cycles, allow a cylinder firing fraction of 0.666 during a predetermined actual total number of engine cycles, and allow a cylinder firing fraction of 0.33 during a predetermined actual total number of engine cycles. All other cylinder firing fractions are not allowed in this example.

The cylinder mode regions shown in FIG. 3A and other cylinder mode regions anticipated, but not shown in the present description may be described as base cylinder mode regions for a base vehicle configuration where the vehicle's total mass is less than a threshold mass (e.g., mass of the vehicle with a single occupant, fueled, and without other additional mass, such as tools or lumber, added to the vehicle). Further, as previously mentioned, the engine may be operated only with all engine cylinders being active when outside of first cylinder mode region 300 and outside of second cylinder mode region 330. Thus, if the engine is operating at a speed less than 320, all engine cylinders are active. Likewise, if the engine is operating at a speed greater than 322, all engine cylinders are active. If the engine enters first cylinder mode region 300 or second cylinder mode region 330, one of the available cylinder modes and/or firing fractions may be activated. If the engine exits first cylinder mode region 300 or second cylinder mode region 330, all engine cylinders are activated.

Referring now to FIG. 3B, a plot showing adjustments to a cylinder activation map for a vehicle when the vehicle configuration is other than for a base vehicle configuration as shown in FIG. 3A. For example, vehicle mass may include an extra mass (payload) over a base vehicle configuration that includes a single occupant and fuel. The plot shows the first cylinder mode region 300 from FIG. 3A and an adjusted first cylinder mode region 300*a* that compensates for an additional mass (e.g., 500 Kg) added to the vehicle. In this example, the first cylinder mode region 300 decreases in size (e.g., the first cylinder mode occupies a smaller engine speed and load range) as mass is added to the vehicle, but the first cylinder mode region may also increase in size depending on the application.

Points 310*a*, 312*a*, 314*a*, and 311*a* define the extents of the first cylinder mode region 300*a* when vehicle mass is increased from the base vehicle mass to maximum gross vehicle weight. The first cylinder mode region may be adjusted to a size between first cylinder mode region 300 and first cylinder mode region 300*a* via interpolating end point values. For example, a point defining the first cylinder mode region for when vehicle mass is greater than a base mass but less than a gross vehicle weight may be established via interpolating between points that define the first cylinder mode when vehicle mass is the base mass and points that define the first cylinder mode when vehicle mass is at a gross vehicle weight. Thus, for points 310 and 310*a* that define a low engine speed high engine load extent of the first cylinder mode region, a point lying along a straight line between point 310 and 310*a* may be determined via determining an equation of a straight line between point 310 and point 310*a* and finding a point along the line that corresponds to the vehicle mass between the base vehicle and a vehicle at gross vehicle weight.

For example, if point 310 is located at (500, 0.5) and point 310*a* is located at (600, 0.3) the equation of the line is $y=(0.5-0.3)/(500-600)x+b$, where $b=1.5$ and $m=(0.2/-100)$ according to an equation of a straight line ($y=mx+b$ where m is the slope of the line and b is the offset of the line, y is the vertical axis value (load), and x is the horizontal axis value (speed)). The length of the straight line is determined by the Pythagorean theorem: $D=\sqrt{(x_2-x_1)^2+(y_2-y_1)^2}$, where D is the distance of the line $x_1$, $x_2$, $y_1$, and $y_2$ are the end points of the line and the engine speed and load locations of the end points. A ratio of the change in vehicle mass to the length of the line is the basis for determining where on the line a vehicle mass (e.g., new vehicle mass) between the base vehicle mass and the vehicle at gross vehicle weight lies on the line. The new vehicle mass is then the basis for determining where the new point on the line representing the new vehicle mass lies. So for example, if this length of the line is 1 and the vehicle mass increases 500 Kg between the base vehicle mass and the gross vehicle mass a ratio of 500/1 is a basis for determining the location of where a 300 Kg increase in vehicle mass lies on the line. In particular, 300 is to 500 as 0.6 is to 1. Thus, the position on the line between point 310 and 310*a* corresponding to a 300 Kg increase in vehicle mass from the base vehicle mass is the point on the line between 310 and 310*a* where the distance from point 310 is 0.66 (e.g., the distance of the line for the 300 Kg vehicle mass increase) times the distance of the line between 310 and 310*a* (e.g., 1). The new point $(x_2, y_2)$ for the 300 Kg vehicle mass increase is solved via solving the Pythagorean theorem for a distance of 0.6 and $x_1=500$ and $y_1=0.5$ for the line $y=(0.2/-100)x+1.5$. In a similar way, other points that define the first cylinder mode region (e.g., points between 311 and 311*a*, points between 314 and 314*a*, and points between 312 and 312*a*) may be determined for different vehicle masses.

In addition, the size of the first cylinder mode region may be adjusted for the way the vehicle weight is carried between the vehicle's front suspension and the vehicle weight carried by the vehicle's rear suspension. Further, the first cylinder mode region may be adjusted based on whether the vehicle mass includes mass of a trailer towed by the vehicle. For example, a location of a point that lies along a straight line between point 310 and 310*a* may be adjusted responsive to vehicle weight carried by the vehicle's front suspension and vehicle weight carried by the vehicle's rear suspension as well as for a portion of the total vehicle mass that is a trailer.

In particular, a length of a line based on vehicle mass that corresponds to a position along the line between 310 and 310*a* is adjusted by an empirically determined factor for vehicle weight carried by the vehicle's front suspension and vehicle weight carried by the vehicle's rear suspension and an empirically determined factor for mass of a trailer being towed by the vehicle. In one example, the length of the line between a base cylinder mode region boundary (e.g., 310 of FIG. 3B) and a cylinder mode region boundary determined from gross vehicle weight (e.g., 310*a* of FIG. 3B) is adjusted to change size (e.g., increase or decrease an engine speed/load boundary) of an engine cylinder mode region when a greater fraction of vehicle weight is supported via the vehicle's rear suspension than the vehicle's front suspension or if there is a change in the amount of mass supported via the vehicle's front or rear suspension. Thus, in the above example, the value of 0.6 corresponding to the length of the line extending from point 310 may be multiplied by a factor of 0.95 for vehicle weight carried by the vehicle's front suspension and vehicle weight carried by the vehicle's rear suspension and a factor of 0.92 for trailer mass so that the length of the line extending from point 310 is 0.6*0.95*0.92=0.5244 The new point defining the extent of the first cylinder mode region and compensating for vehicle weight carried by the vehicle's front suspension and vehicle weight carried by the vehicle's rear suspension and trailer mass is determined via the Pythagorean theorem for a distance of 0.5244 and $x_1$=500 and $y_1$=0.5 for the line y=(0.2/−100)x+1.5. The other points that define the first cylinder mode region may be found in a similar way.

FIG. 3B also includes second cylinder mode region 330*a* defined by points 333*a*, 332*a*, 330*a*, and 331*a* corresponding to a vehicle mass that is different from the vehicle mass that is the basis for second cylinder mode region 330. The points between point 333 and 333*a*, between point 332 and 332*a*, between point 330 and 330*a*, and between point 331 and 331*a* may be found in a similar way as the points between first cylinder mode region 300*a* for a vehicle mass greater than a base vehicle mass and first cylinder mode region 300 for a base vehicle mass.

It should be mentioned that the method described herein is only one non-limiting method for adjusting cylinder mode regions for changes in vehicle mass, trailer tow weight, and vehicle weight carried by the vehicle's front suspension and vehicle weight carried by the vehicle's rear suspension. However, other ways of adjusting the cylinder mode regions are also anticipated. For example, instead of interpolating between points that define a base vehicle cylinder mode region and a maximum gross vehicle weight cylinder mode region, a group of cylinder mode regions may be provided for each incremental increase in vehicle weight (e.g., for every 50 Kg increase in vehicle mass) and the cylinder mode region that is active corresponds to a cylinder mode region for the present vehicle mass plus or minus a predetermined amount of mass. The vehicle weight carried by the vehicle's front suspension and vehicle weight carried by the vehicle's rear suspension and the trailer mass may provide an offset value to the vehicle mass so that the selected cylinder mode region may be different than the cylinder mode region that corresponds to only the vehicle mass.

Thus, if vehicle mass increases or decreases, the cylinder mode regions may increase in size or decrease in size to reduce the possibility of transmitting vibrations to vehicle occupants that may be related to cylinder deactivation. Further, the cylinder mode regions may increase or decrease in size to reduce the possibility of transmitting vibrations to vehicle occupants that may be related to vehicle weight carried by the vehicle's front suspension and vehicle weight carried by the vehicle's rear suspension and/or trailer mass.

Referring now to FIG. 4, a flow chart describing ways of activating cylinder firing fractions and cylinder firing patterns in response to vehicle mass, vehicle weight carried by the vehicle's front suspension and vehicle weight carried by the vehicle's rear suspension, and trailer tow conditions is shown. The method of FIG. 4 may be incorporated into and may cooperate with the system of FIGS. 1-2B. Further, at least portions of the method of FIG. 4 may be incorporated as executable instructions stored in non-transitory memory while other portions of the method may be performed via a controller transforming operating states of devices and actuators in the physical world.

At 402, method 400 determines the vehicle's wheel base and gross vehicle weight. The vehicle's wheel based is a physical distance between the vehicle's front axle and the vehicle's rear axle. The vehicle's gross vehicle weight is the vehicle's maximum weight not including any trailer being towed by the vehicle. The vehicle's wheel base and gross vehicle weight may be determined via accessing values stored in controller memory. The values may be stored to memory at the time of vehicle manufacture. Method 400 proceeds to 404.

At 404, method 400 judges if a trailer is coupled to the vehicle. In one example, method 440 may judge that a trailer is coupled to a vehicle in response to a state of a trailer hitch electrical plug. If method 400 judges that a trailer is coupled to the vehicle, the answer is yes and method 400 proceeds to 420. Otherwise, the answer is no and method 400 proceeds to 406.

At 406, method 400 estimates the vehicle's mass. In one example, vehicle's mass may be estimated via a vehicle ride height sensor. In particular, output of the vehicle ride height sensor is used to index a table of empirically determined vehicle mass estimates that are based on output of the ride height sensor. In other examples, vehicle mass may be estimated from the following equations while the vehicle is accelerating:

$$F=m*a$$

$$Tw/\mathrm{RR}=F$$

$$Tw=m*a*\mathrm{RR}=\mathrm{RR}*m*g*\sin(\theta)$$

where F is the force to accelerate the vehicle, m is vehicle mass estimate, Tw is torque at the vehicle's wheel, RR is the vehicle wheel rolling radius, g is the gravitational constant, and θ is the road angle. The road angle may be determined via an inclinometer or accelerometer and the values of g and RR may be stored in controller memory. Method 400 proceeds to 408 after estimating vehicle mass.

At 408, method 400 estimates vehicle carried by the vehicle's front suspension and the weight carried by the vehicle's rear suspension. In one example, vehicle weight carried by the vehicle's front suspension and vehicle weight carried by the vehicle's rear suspension is estimated via output of vehicle ride height sensors (e.g. front suspension vehicle ride height sensor and rear suspension vehicle ride height sensor. Output of the ride height sensors is input to a function of empirically determined values that outputs an estimate of vehicle weight carried by the vehicle's front suspension and vehicle weight carried by the vehicle's rear suspension. Method 400 proceeds to 410.

At 410, method 400 adjusts cylinder activation maps responsive to vehicle mass and vehicle weight carried by the vehicle's front suspension and vehicle weight carried by the vehicle's rear suspension. In one example, the vehicle includes base cylinder activation maps that correspond to the vehicle's wheel base and the vehicle's gross vehicle weight and different versions of the same model of vehicle may have different gross vehicle weights and different wheel bases. For example, a first vehicle (e.g., truck) has a first wheel base for a short truck bed and a first gross vehicle weight, a second vehicle has a second wheel base for a long truck bed and a second gross vehicle weight, the first wheel base shorter than the second wheel based, the first gross vehicle weight less than the second gross vehicle weight, the first vehicle a same model vehicle as the second vehicle. Thus, the first vehicle and the second vehicle may have different cylinder activation maps even though the first and second vehicles are a same model of vehicle (e.g., both vehicles are Ford® F-150 trucks). A first cylinder activation map may be stored in controller memory of the first vehicle while a second cylinder activation map may be stored in controller memory of the second vehicle. Alternatively, a vehicle may include several cylinder activation maps stored in memory and cylinder activation maps that correspond to the vehicle's wheel base and gross vehicle weight are activated based on the vehicle's determined wheel base and gross vehicle weight to provide a basis for adjusting cylinder firing fraction and cylinder firing patterns during varying vehicle operating conditions.

For example, a base cylinder activation map similar to the one shown in FIG. 3A may be retrieved from memory in response to the vehicle's wheel base and gross vehicle weight. Further, if the vehicle's weight has increased from a base vehicle weight, the base cylinder activation map may be adjusted responsive to the increase in vehicle mass as described with regard to FIG. 3B. For example, the engine speed and load range where additional cylinder modes are allowed to be activated may decrease in size in response to an increase in vehicle mass. The increase in vehicle mass over the base vehicle mass may be due to passengers in the vehicle or cargo (e.g., lumber, steel, or other cargo) or fixtures (e.g., tool boxes). Further, the engine speed and load range where additional cylinder modes are allowed to be activated (e.g. 300 of FIG. 3A) may be increased or decreased in size in response to vehicle weight supported by the vehicle's front suspension and vehicle weight supported by the vehicle's rear suspension as discussed with regard to FIG. 3B. A cylinder activation map speed and load range may be decreased in size via decreasing the engine speed range and engine load range as shown in FIG. 3B where first cylinder mode region 300 is decreased in size to first cylinder mode region 300*a*.

Engine cylinders are activated and deactivated in response to engine speed and engine load. Further, engine cylinders are activated and deactivated in response to the cylinder mode regions that have been adjusted for vehicle mass and vehicle mass supported via the vehicle's front suspension and vehicle mass supported via the vehicle's rear suspension. Method 400 proceeds to exit after adjusting the engine cylinders to activate and deactivate.

At 420, method 400 estimates the vehicle's total mass as described at 406. The vehicle's total mass includes mass of the vehicle and mass of the trailer that is coupled to the vehicle. Method 400 proceeds to 422 after estimating vehicle mass.

At 422, method 400 estimates vehicle mass carried by the vehicle's front suspension and the mass carried by the vehicle's rear suspension as described at 408. Further, method 400 subtracts a mass from the mass the vehicle's rear suspension is determined to be carrying based on the difference in mass of the total vehicle and mass of the vehicle supported via the vehicle's front and rear suspensions. For example, if the vehicle's total mass is estimated to be 3200 Kg including the trailer coupled to the vehicle, and the vehicle's front suspension is estimated to be carrying 1430 Kg and the vehicle's rear suspension is estimated to be carrying 770 Kg, the trailer's initial mass is estimated to be 1000 Kg. However, since the vehicle may carry weight from the trailer (e.g., trailer tongue mass), a fraction of the mass carried by the vehicle's rear suspension may be subtracted from the mass carried by the vehicle's rear suspension and added to the trailer. In one example, an empirically estimated amount of mass may be subtracted from the mass carried by the vehicle's rear suspension and added to the trailer mass. The empirically amount of mass may be a function of the estimate of the trailer's mass before the tongue mass is added into the trailer mass. Method 400 proceeds to 424.

At 424, method 400 estimates the mass of the trailer towed by the vehicle. In particular, the mass carried by the front vehicle suspension and the mass carried by the rear vehicle suspension determined at 422 is subtracted from the total vehicle mass estimated at 420 to provide the estimate of mass of the trailer towed by the vehicle. Method 400 proceeds to 426.

At 426, method 400 adjusts cylinder activation maps responsive to vehicle mass (not including trailer), vehicle mass carried by the vehicle's front suspension and vehicle mass carried by the vehicle's rear suspension, and trailer mass. In one example, the vehicle includes base cylinder activation maps that correspond to the vehicle's wheel base and the vehicle's gross vehicle weight and different versions of the same model of vehicle may have different gross vehicle weights and different wheel bases as described at 410.

A base cylinder activation map similar to the one shown in FIG. 3A may be retrieved from memory in response to the vehicle's wheel base and gross vehicle weight. In addition, if the vehicle's mass has increased from a base vehicle weight, the base cylinder activation map may be adjusted responsive to the increase in vehicle mass as described with regard to FIG. 3B. In one example, the engine speed and load range where additional cylinder modes are allowed to be activated may decrease in size in response to an increase in vehicle mass. The increase in vehicle mass over the base vehicle mass may be due to passengers in the vehicle or cargo (e.g., lumber, steel, or other cargo) or fixtures (e.g., tool boxes). Further, the engine speed and load range where additional cylinder modes are allowed to be activated (e.g. 300 of FIG. 3A) may be increased or decreased in size in response to vehicle weight supported by the vehicle's front suspension and vehicle weight supported by the vehicle's rear suspension as discussed with regard to FIG. 3B. A cylinder activation map speed and load range may be decreased in size via decreasing the engine speed range and engine load range as shown in FIG. 3B where first cylinder mode region 300 is decreased in size to first cylinder mode region 300*a*. In addition, the cylinder activation map cylinder mode range may be increased and decreased in size via increasing the cylinder mode region 300 in response to trailer mass as described in reference to FIG. 3B. The vehicle's mass may affect the transmission of vibrational energy through the vehicle. Further, the location of the mass relative to the engine may affect the transmission of vibrational energy through the vehicle. Mass of a trailer being towed by the vehicle may have less effect of vibrational energy transfer as compared to mass of weight supported via the vehicle's front suspension. Nevertheless, mass of a trailer being towed may have some affect on transmission of vibrational energy through the vehicle. Thus, by adjusting the size or engine speed and load range of cylinder mode ranges in cylinder activation maps, the possibility of disturbing vehicle occupants due to cylinder activation and deactivation may be reduced.

The engine's cylinders are activated and deactivated in response to engine speed and engine load. Further, engine cylinders are activated and deactivated in response to the cylinder mode regions that have been adjusted for vehicle mass, vehicle weight supported via the vehicle's front suspension and vehicle weight supported via the vehicle's rear suspension, and trailer mass. Method 400 proceeds to exit after adjusting the engine cylinders to activate and deactivate.

Thus, the method of FIG. 4 provides for an engine method, comprising: increasing an actual total number of engine cylinder modes that include active cylinders according to an engine cylinder mode region of an engine cylinder activation map via a controller in response to a change of engine speed or engine load, the cylinder mode region adjusted in response to a change in vehicle mass; and activating and deactivating engine cylinders in response to the change of engine speed or engine load. The method further comprises estimating the change in vehicle mass based on acceleration of a vehicle. The method includes where active cylinders combust air and fuel.

In some examples, the method further comprises increasing an actual total number of engine cylinder modes that include deactivated cylinders according to the engine cylinder mode region of the engine cylinder activation map via the controller in response to the change of engine speed or engine load. The method includes where adjusting the cylinder mode region in response to a change in vehicle mass includes decreasing a range of engine speeds where the actual total number of engine cylinder modes is increased in response to an increase in vehicle mass. The method also includes where adjusting the cylinder mode region in response to a change in vehicle mass includes decreasing a range of engine loads where the actual total number of engine cylinder modes is increased in response to an increase in vehicle mass. The method includes where adjusting the cylinder mode region in response to a change in vehicle mass includes increasing a range of vehicle speeds where the actual total number of engine cylinder modes is increased in response to a decrease in vehicle mass.

The method of FIG. 4 also provides for an engine method, comprising: adjusting an engine cylinder mode region of an engine cylinder activation map via a controller in response to a change of location of a vehicle load from a front vehicle suspension to a rear vehicle suspension; and activating and deactivating engine cylinders via the controller in response to a change of engine speed or engine load such that an engine enters the engine cylinder mode region. The method includes where adjusting the engine cylinder mode region includes increasing an engine speed range and an engine load range that are extents of the engine cylinder mode region. The method includes where adjusting the engine cylinder mode region includes decreasing an engine speed range and an engine load range that are extents of the engine cylinder mode region.

In some examples, the method further comprises further adjusting the engine cylinder mode region via the controller in response to a vehicle towing a trailer. The method includes where the engine cylinder mode region identifies active cylinder modes and active cylinder patterns. The method further comprises bounding the cylinder mode region based on engine speed and engine load. The method further comprises adjusting boundaries of a plurality of cylinder mode regions in response to mass of a vehicle.

Figure 5A:
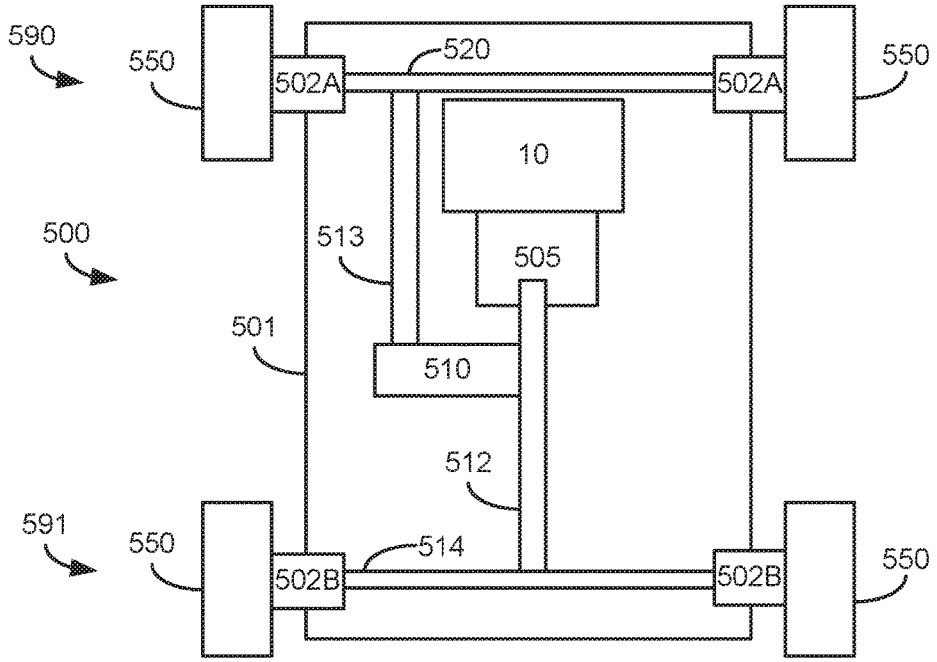
FIGS. 5A and 5B show example vehicle chassis and suspension components for a vehicle that includes cylinder deactivation.
Figure 5B:
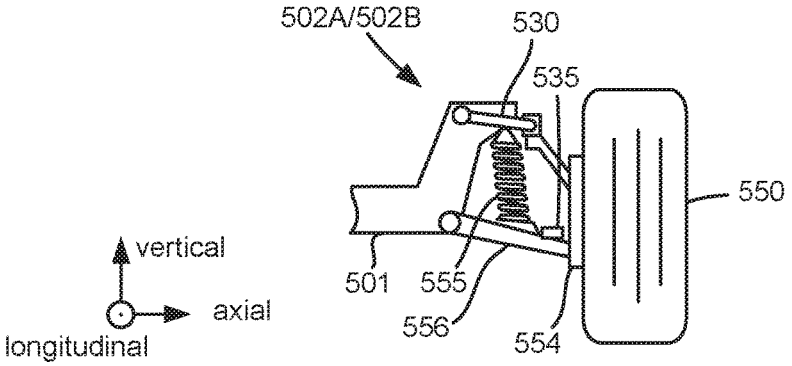

Turning now to FIG. 5A, an example vehicle is shown. Vehicle 500 include engine 10 shown in FIG. 1 and transmission 505. Transmission 505 relays torque from engine 10 to rear axis 514 via driveshaft 512. Transmission 505 is also shown with optional transfer case 510 that may direct engine torque to front axle 520 via driveshaft 513. Suspension 502A and 502B supports the mass of vehicle 500 and it allows relative motion between wheels 550 and vehicle chassis 501. One example of suspension 502A and 502B is shown in FIG. 5B. A front 590 of vehicle 500 includes engine 10 while rear 591 of vehicle 500 includes rear axle 514. In other examples, front axle 520 may be omitted. In still other examples, engine 10 may supply torque to wheels 550 at front 590 of vehicle without supplying torque to rear 591 of vehicle 500. A portion of the vehicle mass may be supported by front suspension 502A at the front 590 of vehicle 500 (e.g., the front suspension). A portion of vehicle mass may be supported by rear suspension 502B at rear 591 of vehicle 500.

Referring now to FIG. 5B, an example of front suspension 502A and rear suspension 502B is shown. Suspension 502A/502B includes an upper control arm 530, a ride height sensor 535, a lower control arm 556, and a wheel hub 554. Wheel hub 544 supports wheel 550 and chassis 501 is shown coupled to upper control arm 530 and lower control arm 556. Spring 555 provides force to separate upper control arm 530 from lower control arm 556, thereby supporting mass of vehicle 500. A similar arrangement may be found at each wheel 550 of vehicle 500.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, at least a portion of the described actions, operations and/or functions may graphically represent code to be programmed into non-transitory memory of the computer readable storage medium in the control system. The control actions may also transform the operating state of one or more sensors or actuators in the physical world when the described actions are carried out by executing the instructions in a system including the various engine hardware components in combination with one or more controllers.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The invention claimed is:

1. A method for an engine, comprising:

via a controller, providing an engine cylinder mode region of an engine cylinder activation map, the engine cylinder mode region defined by a boundary where within the boundary an actual total number of engine cylinder modes that include active cylinders is increased as compared to outside the boundary where all cylinders are active, where the actual total number of engine cylinder modes includes selected cylinder firing patterns and/or selected cylinder firing fractions over a predetermined number of cycles of the engine, and where the boundary is adjusted via the controller in response to a change in vehicle mass;

entering into the engine cylinder mode region in response to a change of engine speed or engine load; and activating and deactivating engine cylinders according to the selected cylinder firing patterns and/or selected cylinder firing fractions over the predetermined number of cycles of the engine in response to the change of engine speed or engine load.

2. The method of claim 1, further comprising estimating the change in vehicle mass based on acceleration of a vehicle.

3. The method of claim 1, where active cylinders combust air and fuel.

4. The method of claim 1, where the actual total number of engine cylinder modes that include active cylinders further include deactivated cylinders according to the engine cylinder mode region of the engine cylinder activation map.

5. The method of claim 1, where adjusting the boundary of the engine cylinder mode region in response to the change in vehicle mass includes decreasing a range of engine speeds where the actual total number of engine cylinder modes is increased in response to an increase in vehicle mass.

6. The method of claim 1, where adjusting the boundary of the engine cylinder mode region in response to the change in vehicle mass includes decreasing a range of engine loads where the actual total number of engine cylinder modes is increased in response to an increase in vehicle mass.

7. The method of claim 1, where adjusting the boundary of the engine cylinder mode region in response to the change in vehicle mass includes increasing a range of vehicle speeds where the actual total number of engine cylinder modes is increased in response to a decrease in vehicle mass.

8. A method for an engine, comprising:

adjusting an engine cylinder mode region of an engine cylinder activation map via a controller in response to a change of location of a vehicle load from a front vehicle suspension to a rear vehicle suspension; and activating and deactivating engine cylinders via the controller in response to a change of engine speed or engine load such that the engine enters the engine cylinder mode region.

9. The method of claim 8, where adjusting the engine cylinder mode region includes increasing an engine speed range and an engine load range that are extents of the engine cylinder mode region.

10. The method of claim 8, where adjusting the engine cylinder mode region includes decreasing an engine speed range and an engine load range that are extents of the engine cylinder mode region.

11. The method of claim 8, further comprising further adjusting the engine cylinder mode region via the controller in response to a vehicle towing a trailer.

12. The method of claim 8, where the engine cylinder mode region identifies active cylinder modes and active cylinder patterns.

13. The method of claim 8, further comprising bounding the engine cylinder mode region based on engine speed and engine load.

14. The method of claim 8, further comprising adjusting boundaries of a plurality of engine cylinder mode regions in response to mass of a vehicle.

15. An engine system, comprising:

an engine including one or more cylinder deactivating mechanisms;

a controller including executable instructions stored in non-transitory memory to adjust dimensions of an engine cylinder mode region of an engine cylinder activation map, the engine cylinder mode region defined by a boundary where within the boundary an actual total number of engine cylinder modes that include active cylinders is increased as compared to outside the boundary where all cylinders are active, in response to a change in mass of a vehicle, the change in mass of the vehicle including a way in which vehicle weight is carried between a front suspension and a rear suspension of the vehicle.

16. The engine system of claim 15, further comprising additional executable instructions to adjust the engine cylinder mode region in response to a wheel base of the vehicle.

17. The engine system of claim 15, further comprising additional executable instructions to adjust the engine cylinder mode region in response to the vehicle towing a trailer.

18. The engine system of claim 15, further comprising additional executable instructions to estimate a mass of the vehicle.

19. The engine system of claim 15, further comprising additional executable instructions to estimate a mass of a trailer coupled to the vehicle.

20. The engine system of claim 15, where the engine cylinder mode region defines active cylinder firing fractions and active cylinder patterns.

* * * * *